US011814861B2

(12) United States Patent
Martins et al.

(10) Patent No.: US 11,814,861 B2
(45) Date of Patent: Nov. 14, 2023

(54) FENCE CAP SYSTEM

(71) Applicant: PLM Solutions Inc., Ontario (CA)

(72) Inventors: Alvaro Martins, Ontario (CA); Luis Ruivo, Quebec (CA)

( * ) Notice: Subject to any disclaimer, the term of this patent is extended or adjusted under 35 U.S.C. 154(b) by 274 days.

(21) Appl. No.: 17/482,775

(22) Filed: Sep. 23, 2021

(65) Prior Publication Data

US 2022/0106808 A1 Apr. 7, 2022

Related U.S. Application Data

(60) Provisional application No. 63/086,177, filed on Oct. 1, 2020.

(51) Int. Cl.
*E04H 17/00* (2006.01)

(52) U.S. Cl.
CPC ..... *E04H 17/006* (2021.01)

(58) Field of Classification Search
USPC ..... 403/308, 326, 329, 375, 385; 52/300, 52/301; 256/1, 19
See application file for complete search history.

(56) References Cited

U.S. PATENT DOCUMENTS 1,707,397 A * 4/1929 Hurst ..... E04H 17/006 52/301
2,450,345 A * 9/1948 Kervin ..... A01G 17/14 52/301
2,998,110 A * 8/1961 Hutzelman ..... E04B 2/7433 52/301
3,156,331 A * 11/1964 Sklar ..... E06B 3/9885 49/505
3,250,049 A * 5/1966 Sklar ..... E06B 1/6061 52/211
3,794,826 A * 2/1974 Jablonski ..... F21V 21/116 362/396
4,761,319 A * 8/1988 Kraus ..... B62D 25/24 428/66.3
5,201,157 A * 4/1993 Thornton ..... E04H 12/2292 220/325
5,299,883 A * 4/1994 Arth, Jr. ..... E01F 15/0469 52/301
5,419,536 A * 5/1995 Bender ..... E04H 17/006 52/301
5,421,556 A * 6/1995 Dodge ..... E04H 17/006 403/375
5,704,188 A * 1/1998 Coulis ..... E04C 3/36 248/156
5,709,057 A * 1/1998 Johnson, Jr. ..... E01F 9/65 52/27
5,765,312 A * 6/1998 Szyjkowski ..... E04F 19/083 49/463
6,138,422 A * 10/2000 Wall ..... E04H 12/2292 52/301

(Continued)

*Primary Examiner* — Joshua K Ihezie
(74) *Attorney, Agent, or Firm* — TCP Law, Pllc

(57) ABSTRACT

A fence cap system, comprising a cover, a cap claw, a securing screw, wherein the cover includes an upper portion that is pyramid-shaped with an apex and a base, the apex including a cover hole designed to receive the securing screw, wherein the cap claw includes a center portion that includes a claw hole designed to receive the securing screw, and wherein the securing screw secures the cap claw to the cover when it is received through the cover hole and the claw hole.

6 Claims, 5 Drawing Sheets

(56) References Cited

U.S. PATENT DOCUMENTS

| | | | | |
|---|---|---|---|---|
| 6,557,829 | B1 * | 5/2003 | Steffes | E04H 17/143 256/19 |
| 6,585,398 | B1 * | 7/2003 | Haddad | F21V 5/02 362/253 |
| 6,722,637 | B2 * | 4/2004 | Burkart | E04H 17/017 256/19 |
| 7,341,242 | B2 * | 3/2008 | Bertato | E04H 17/1439 256/65.11 |
| 7,578,099 | B2 * | 8/2009 | Schlegel | E04H 12/2292 174/91 |
| 8,844,907 | B1 * | 9/2014 | Davis | E04H 17/006 403/329 |
| 10,100,551 | B2 * | 10/2018 | Pacheco | E04H 17/006 |
| 10,190,329 | B2 * | 1/2019 | Kobelt | E04H 12/04 |
| 11,015,365 | B2 * | 5/2021 | Loucks | E04H 17/1417 |
| 11,041,516 | B2 * | 6/2021 | Blank | E04H 17/20 |
| 2003/0122115 | A1 * | 7/2003 | Ernst | E04H 17/006 256/1 |
| 2011/0133145 | A1 * | 6/2011 | Morrow | E04H 17/17 256/65.11 |
| 2011/0180773 | A1 * | 7/2011 | Pacheco | E04H 17/006 72/347 |
| 2012/0235105 | A1 * | 9/2012 | Yasher | E04H 17/21 256/65.06 |
| 2016/0273240 | A1 * | 9/2016 | Kobelt | E04H 12/04 |
| 2017/0314292 | A1 * | 11/2017 | Pacheco | E04H 17/006 |
| 2018/0094452 | A1 * | 4/2018 | Loucks | E04H 17/20 |

* cited by examiner

FENCE CAP SYSTEM

CROSS-REFERENCE TO RELATED APPLICATIONS

This application claims priority to U.S. provisional patent application Ser. No. 63/086,177, titled "Fence Cap System," and filed on Oct. 1, 2020, which is hereby incorporated by reference herein in its entirety.

FIELD OF THE INVENTION

This application relates to a fence cap system and, more specifically, a fence cap system capable of installing onto the top of fence posts over a range of different fence post sizes.

BACKGROUND

When wooden posts are installed in the ground to support a fence, play center, mailboxes, or the like, the post may have a range of sizes to accommodate various things to be supported. Irrespective of the fence post size, the top portion of the fence post or the end grain may be exposed to the elements and acts as a straw, sucking in the surrounding moisture. This moisture will create rot and open the grain of the fence post to cracking. What is needed is to efficiently protect the top of fence posts over a range of different fence post sizes.

SUMMARY

In some embodiments, a fence cap system is provided, the fence cap system including a cover, a cap claw, a securing screw, wherein the cover includes an upper portion that is pyramid-shaped with an apex and a base, the apex including a cover hole designed to receive the securing screw, wherein the cap claw includes a center portion that includes a claw hole designed to receive the securing screw, and wherein the securing screw secures the cap claw to the cover when it is received through the cover hole and the claw hole.

In some embodiments, a method of manufacturing a fence cap system is provided, the method of manufacturing including providing a cover, providing a cap claw, providing a securing screw, wherein the cover includes an upper portion that is pyramid-shaped with an apex and a base, the apex including a cover hole designed to receive the securing screw, wherein the cap claw includes a center portion that includes a claw hole designed to receive the securing screw, and wherein the securing screw secures the cap claw to the cover when it is received through the cover hole and the claw hole.

Still, other aspects, features, and advantages of this disclosure may be readily apparent from the following detailed description, as illustrates by the example embodiments. This disclosure may also be capable of other and different embodiments, and its several details may be modified in various respects. Accordingly, the drawings and descriptions are to be regarded as illustrative and not as restrictive.

BRIEF DESCRIPTION OF THE DRAWINGS

The drawings described below are for illustrative purposes only and are not necessarily drawn to scale. The drawings are not intended to limit the scope of the disclosure in any way. Wherever possible, the same or like reference numbers are used throughout the drawings to refer to the same or like parts.

DETAILED DESCRIPTION

As mentioned above, this application relates to a fence cap system and, more specifically, to a fence cap system capable of installation onto the top of fence posts having a range of sizes.

Figure 1:
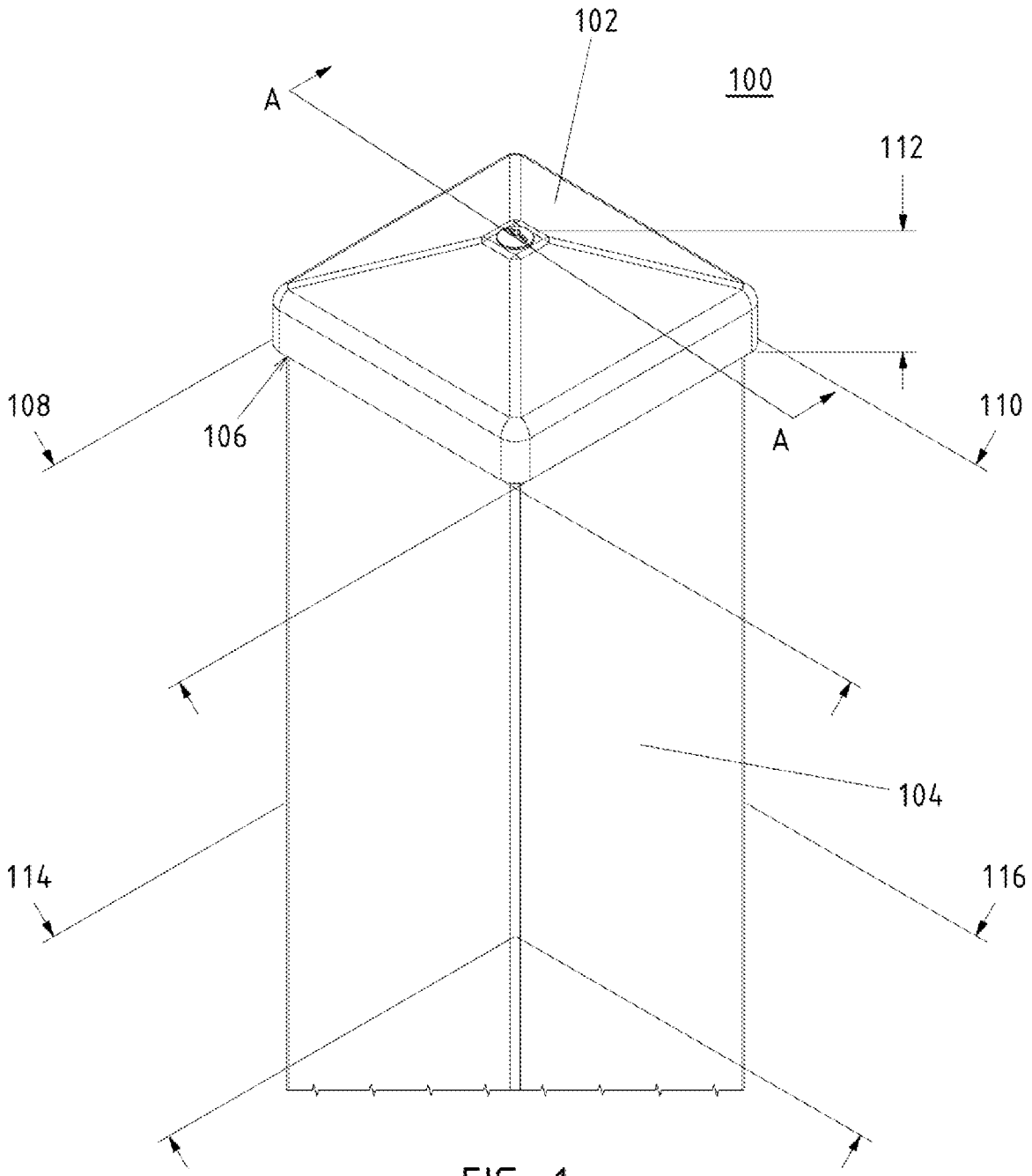
FIG. 1 is a top perspective view of a fence cap system installed on a fence post according to the embodiments disclosed herein.

FIG. 1 is a top perspective view 100 of a fence cap system 102 installed on a fence post 104 according to the embodiments disclosed herein. The fence cap system 102 may be installed on a top portion 106 of the fence post 104 to protect the top portion 106 of the fence post 104 from the weather and the surrounding environment in general.

The fence cap system 102 of one size includes a cap length 108, a cap width 110, and a cap height 112 that may fit the top portion 106 of the fence post 104 over a range of fence post sizes that include a post length 114 and a post width 116. In one exemplary embodiment, a fence cap system 102 with a cap length 108 of four and five-eighths inches (4⅝"), a cap width 110 of four and five-eighths inches (4⅝"), and a cap height 112 of one and three-quarters inches (1¾") may be installed on fence posts 104 whose dimensions range from a post length 114 of three and three-eighths inches (3⅜") and a post width 116 of three and three-eighths inches (3⅜") to a post length 114 of four and three-sixteenths inches (4 3/16") and a post width of four and three-sixteenths inches (4 3/16").

Similarly, a fence cap system 102 with a cap length 108 of six and one-half inches (6½"), a cap width 110 of six and one-half inches (6½"), and a cap height 112 of two inches (2") may be installed on fence posts 104 whose dimensions range from a post length 114 of five and one-half inches (5½") and a post width 116 of five and one half inches (5½") to a post length 114 of six inches (6") and a post width 116 of six inches (6").

Figure 2:
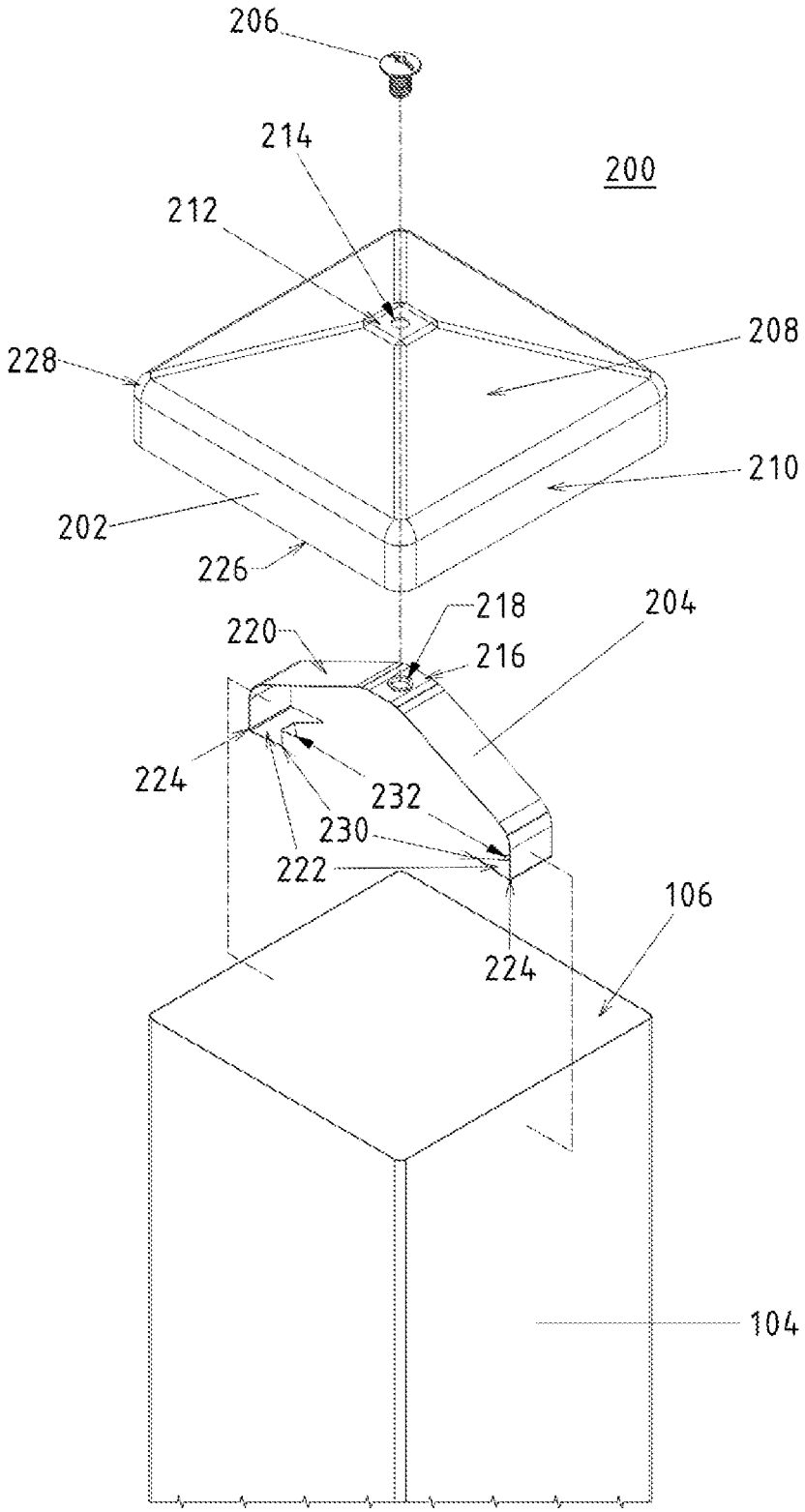
FIG. 2 is an exploded view of the fence cap system according to the embodiments disclosed herein.

FIG. 2 is an exploded view 200 of the fence cap system 102 according to the embodiments disclosed herein. The fence cap system 102 may include a cover 202, a cap claw 204, and a securing screw 206.

The cover 202 may include an upper portion 208 and a lower portion 210. The upper portion 208 may be generally pyramid-shaped with an apex 212 and a base 228. The apex 212 may include a cover hole 214 designed to receive the securing screw 206.

The lower portion 210 may extend downward from the base 228 of the upper portion 208 and may be generally square-shaped to match or envelope any shape of the top portion 106 of the fence post 104.

The cover 202 may be formed from any rigid material known to one of ordinary skill in the art that is water-resistant, including G90 galvanized steel.

The cap claw 204 allows the cover 202 of one size to be effectively coupled to fence posts 104 over a range of sizes. The cap claw 204 is shaped and sized to fit under and follow the shape and size of the cover 202.

The cap claw 204 may include a center portion 216 with a claw hole 218 designed to receive the securing screw 206. The center portion 216 of the cap claw 204 may be aligned with the apex 212 of the upper portion 208 such that the securing screw 206 may be received through both the cover hole 214 and the claw hole 218. The securing screw 206 may secure the cap claw 204 to the cover 202 once it has been received through the cover hole 214 and the claw hole 218.

A pair of arms 220 extend downward from opposite sides of the center portion 216. Each of the pair of arms 220 extends downward from the apex 212 of the upper portion 208 to the bottom 226 of the lower portion 210. The pair of arms 220 are each shaped to generally follow the shape of the upper portion 208 and the lower portion 210.

A fin 222 extends from an end 224 of each of the pair of arms 220. The fin 222 is forked shaped with at least three prongs 230 that face toward the center portion 216. The pair of arms 220 are designed to be flexible about the center portion 216, which may vary a distance 232 between the fin 222 extending from each of the pair of arms 220.

Figure 3:
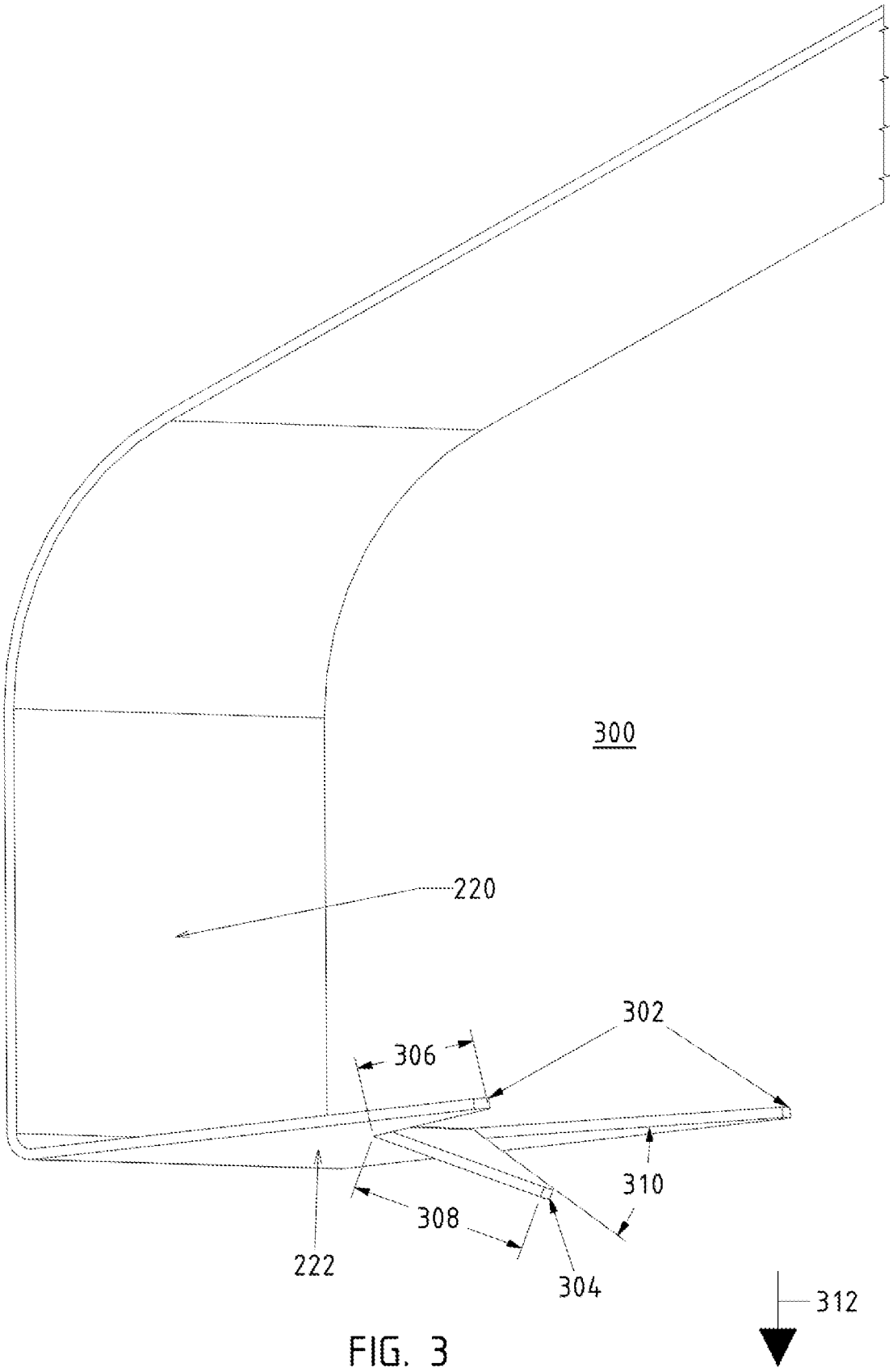
FIG. 3 is a close-up view of an embodiment of the fin extending from each of the pair of arms included within the fence cap system according to the embodiments disclosed herein.

FIG. 3 is a close-up view 300 of an embodiment of the fin 222 extending from each of the pair of arms 220 included within the fence cap system 102 according to the embodiments disclosed herein.

The fin 222 is forked shaped with two outer prongs 302 and one center prong 304. The two outer prongs 302 are parallel to one another, with each having a first length 306 that is longer than a second length 308 of the center prong 304. Moreover, the center prong 304 extends outward at an angle Ø 310 relative to the two outer prongs 302.

Specifically, the center prong 304 extends at a negative Ø 310 such that it extends downward 312 away from the two outer prongs 302 and the center portion 216 of the cap claw 204.

In one embodiment, the center prong 304 extends at a negative 30-degree angle relative to the two outer prongs 302.

Figure 4:
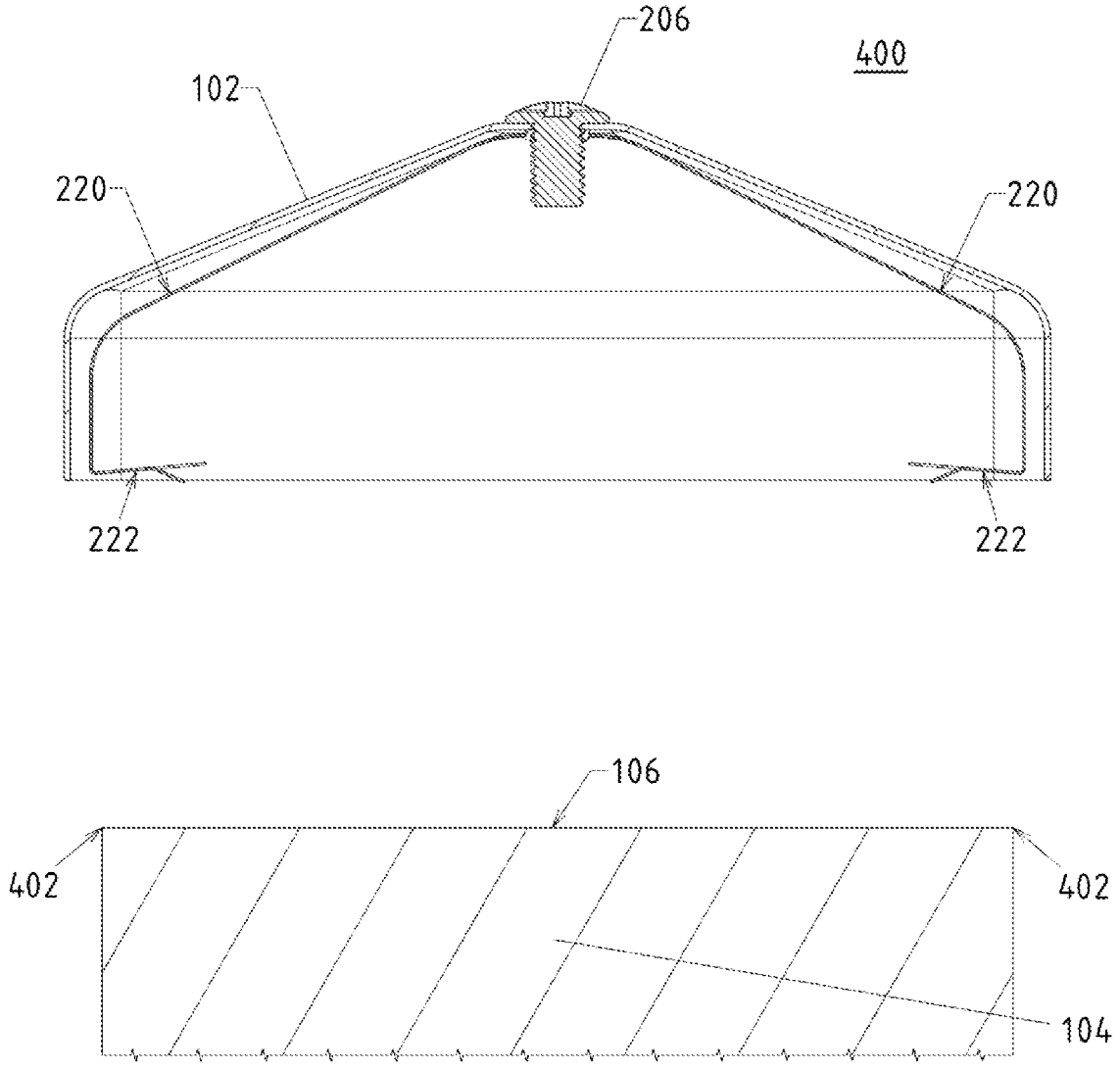
FIG. 4 is a front view along line A-A' in FIG. 1 of the fence cap system positioned over a top portion of the fence post according to the embodiments disclosed herein.

FIG. 4 is a front view 400 along line A-A' in FIG. 1 of the fence cap system 102 positioned on the top portion 106 of the fence post 104 according to the embodiments disclosed herein. In preparation for installation, the fence cap system 102 is positioned above the top portion 106 of the fence post 104 with the securing screw 206 centered on the top portion 106. In this position, the fin 222 extending from each of the pair of arms 220 is generally lined up with opposing edges 402 of the fence post 104.

Figure 5:
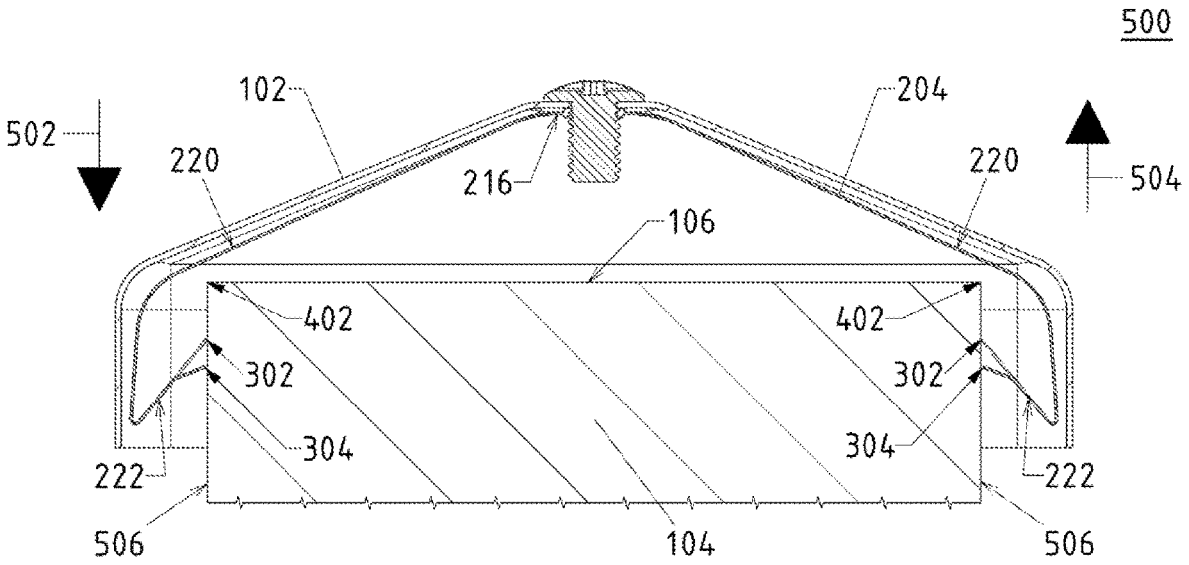
FIG. 5 is a front view along line A-A' in FIG. 1 of the fence cap system installed onto the top of a fence post of a first size according to the embodiments disclosed herein.

FIG. 5 is a front view 500 along line A-A' in FIG. 1 of the fence cap system 102 installed onto the top portion 106 of a fence post 104 of a first size according to the embodiments disclosed herein.

As the fence cap system 102 is pushed downward 502 towards the top portion 106 of the fence post 104, the two outer prongs 302 of the fin 222 extending from each of the pair of arms 220 comes into contact and interact with the edges 402 of the fence post 104. The interaction between the two outer prongs 302 and the edges 402 results in the fin 222 extending from each of the pair of arms 220 bending upward 504 towards the center portion 216 of the cap claw 204. As the fin 222 extending from each of the pair of arms 220 is bent, the center prong 304 of the fin 222 comes into contact with and penetrates into opposite sides 506 of the fence post 104. The fence cap system 102 may continue downward 502 until the edges 402 of the fence post 104 come into contact with the pair of arms 220. The two outer prongs 302 and the center prongs 304 force the fence cap system 102 to center itself on the fence post 104 as it is being installed over the top portion 106 of the fence post 104.

Figure 6:
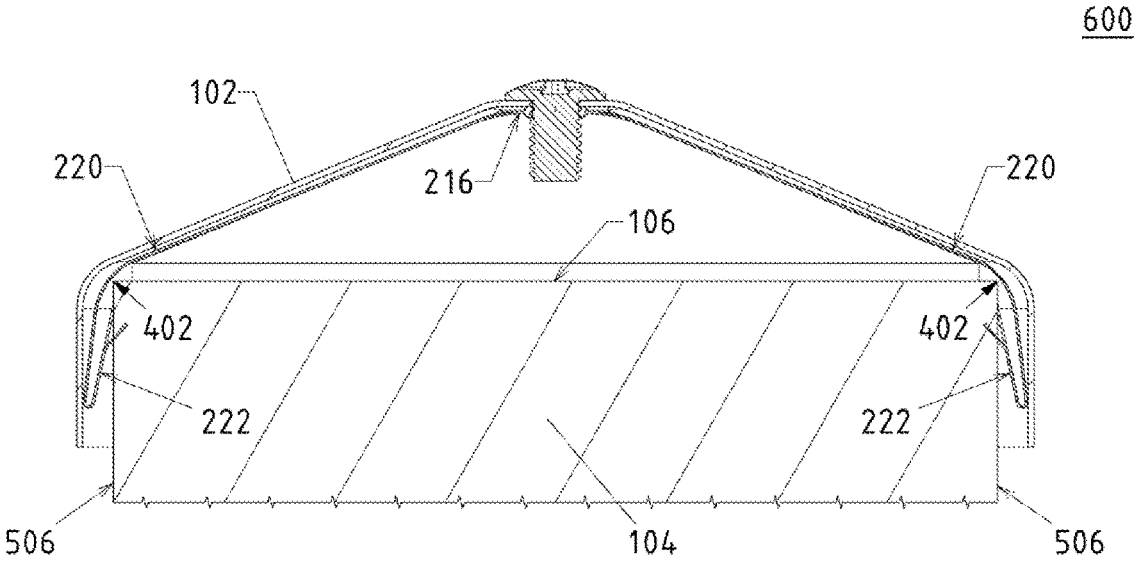
FIG. 6 is a front view along line A-A' in FIG. 1 of the fence cap system installed onto the top of a fence post of a second size according to the embodiments disclosed herein.

FIG. 6 is a front view 600 along line A-A' in FIG. 1 of the fence cap system 102 installed onto the top portion 106 of a fence post 104 of a second size according to the embodiments disclosed herein.

The second size being greater than the first size discussed in FIG. 5, the fin 222 extending from each of the pair of arms 220 is bent further upward 504 until the edges 402 of the fence post 104 come into contact with the pair of arms 220. The center prong 304 comes into greater contact with and penetrates further into the opposite sides 506 of the fence post 104. Moreover, the pair of arms 220 flex further about the center portion 216 to accommodate the greater second size of the fence post 104.

The combination of the two outer prongs 302 and the center prong 304 on the fin 222 extending from each of the pair of arms 220 secures the fence cap system 102 to the fence post 104.

The foregoing description discloses only exemplary embodiments. Modifications of the above-disclosed assemblies and methods that fall within this disclosure's scope will be readily apparent to those of ordinary skill in the art.

This disclosure is not intended to limit the invention to the particular assemblies and/or methods disclosed, but, to the contrary, the intention is to cover all modifications, equivalents, and alternatives falling within the scope of the claims.

What is claimed is:

1. A fence cap system, comprising:

a cover;

a cap claw;

a securing screw;

the cover comprising an upper portion that is pyramid-shaped with an apex and a base, the apex comprising a cover hole designed to receive the securing screw;

the cap claw comprising a center portion and a pair of arms extending from opposite edges of the center portion;

wherein the center portion comprises a claw hole designed to receive the securing screw;

wherein the pair of arms comprises a fin extending inward towards the center portion from an end of each of the pair of arms;

wherein the fin extending from each of the pair of arms comprises two outer prongs and one center prong positioned in between the two outer prongs, the center prong extending at an angle relative to the two outer prongs; and the securing screw securing the cap claw to the cover when it is received through the cover hole and the claw hole.

2. The fence cap system of claim 1, wherein the angle relative to the two outer prongs is negative such that the center prong extends downward relative to the two outer prongs and away from the center portion of the cap claw.

3. The fence cap system of claim 1, wherein the two outer prongs have a first length and the center prong has a second length, the first length being greater than the second length.

4. The fence cap system of claim 1, wherein the cap claw is positioned under the cover while secured to the cover with the securing screw.

5. The fence cap system of claim 1, wherein the cover further comprises a lower portion extending downward from the base of the upper portion away from the apex of the upper portion.

6. A method of manufacturing a fence cap system including the steps of:

providing a cover;

providing a cap claw;

providing a securing screw;

the cover comprising an upper portion that is pyramid-shaped with an apex and a base, the apex including a cover hole designed to receive the securing screw;

the cap claw comprising a center portion and a pair of arms extending from opposite edges of the center portion;

wherein the center portion comprises a claw hole designed to receive the securing screw;

wherein the pair of arms comprises a fin extending inward towards the center portion from an end of each of the pair of arms;

wherein the fin extending from each of the pair of arms comprises two outer prongs and one center prong positioned in between the two outer prongs, the center prong extending at an angle relative to the two outer prongs; and the securing screw securing the cap claw to the cover when it is received through the cover hole and the claw hole.

* * * * *